US005932287A

United States Patent [19]

Michelsen et al.

[11] Patent Number: 5,932,287

[45] Date of Patent: Aug. 3, 1999

[54] MANUFACTURE OF BUILT-UP ROOFING PRODUCTS WITH MOISTURE CONDITIONED FIBROUS MATS

[75] Inventors: Theodore W. Michelsen, Lakewood, Colo.; Byron James Lemonier, Gurnee, Ill.; Brian Francis Olson, Edmond, Okla.; Gary Allen Lundholm, Gurnee, Ill.

[73] Assignee: Johns Manville International, Inc., Denver, Colo.

[21] Appl. No.: 08/992,993

[22] Filed: Dec. 18, 1997

[51] Int. Cl.[6] ..... B05D 3/00

[52] U.S. Cl. ..... 427/315; 427/209; 427/299; 427/443

[58] Field of Search ..... 427/186, 209, 427/309, 315, 427, 422, 428, 434.2, 443, 443.2, 294

[56] References Cited

U.S. PATENT DOCUMENTS

| | | | |
|---|---|---|---|
| 3,783,000 | 1/1974 | Takase et al. | 427/211 |
| 4,107,375 | 8/1978 | Iwasaki et al. | 428/291 |
| 4,873,303 | 10/1989 | Blackwood et al. | 427/365 |
| 5,169,690 | 12/1992 | Zimmerman et al. | 427/389.8 |

*Primary Examiner*—Shrive Beck
*Assistant Examiner*—Michael Barr
*Attorney, Agent, or Firm*—Robert D. Touslee

[57] ABSTRACT

A method of manufacturing roofing felts, cap sheets, base sheets and similar built-up roofing products from fibrous mats includes: supplying a roofing mat to a manufacturing process; moisturizing the roofing mat by applying steam or a liquid mist to one or both major surfaces of the roofing mat during the manufacturing process to increase the moisture content of the roofing mat and reduce the amount of hot bitumen accepted by the roofing mat during a coating operation; and applying a hot bitumen coating to one or both major surfaces of the roofing mat during the manufacturing process after the moisture content of the roofing mat has been increased by the moisturizing step.

24 Claims, 1 Drawing Sheet

MANUFACTURE OF BUILT-UP ROOFING PRODUCTS WITH MOISTURE CONDITIONED FIBROUS MATS

BACKGROUND OF THE INVENTION

The present invention relates to a method of manufacturing roofing felts, cap sheets, base sheets and similar built-up roofing products and, in particular, to a method of manufacturing such built-up roofing products in which the fibrous roofing mats are moisturized, preferably with steam (water vapor) prior to the application of a bituminous coating (an asphalt or coal tar coating) to reduce the amount of the bituminous coating required to produce the built-up roofing products.

Built-up roofing products, such as roofing felts, cap sheets and base sheets, are manufactured by coating roofing mats with a hot bitumen, such as asphalt or coal tar, to impregnate or saturate the roofing mats with the hot bitumen. After a roofing mat has been coated with the hot bitumen, the coated roofing mat is cooled to cool the bitumen; one or both major surfaces of the coated roofing mat are normally coated with a release agent, such as a liquid parting agent or a sand surfacing, to keep the bitumen from the coated roofing mat from adhering to the equipment rolls and to keep adjacent convolutions of the coated roofing mat from sticking together when wound up into a roll; and the finished product, the roofing felt, cap sheet or base sheet, is typically wound up into a roll for storage and shipment.

Roofing felts, cap sheets and base sheets are typically used to form built-up roof membranes on roof decks wherein plies of these built-up roofing products and hot asphalt or bitumen are applied to the roof decks to form the built-up roof membrane. The hot asphalt or bitumen is applied to the roof deck by mopping the asphalt or bitumen onto the deck and plies of the built-up roofing products which function to stabilize the mopped asphalt or bitumen and keep the asphalt or bitumen, which is otherwise an excellent water barrier, from cracking and leaking.

The roofing mat used in the manufacture of built-up roofing products, such as roofing felts, cap sheets and base sheets, is typically made of randomly oriented glass fibers which are laid down in a dry process or a wet process. Preferably, the roofing mat is made of randomly oriented glass fibers that have been laid down in a wet process to form the mat. Glass fiber roofing mats, made by a wet process such as a Fourdrinier type of process, are preferred because these wet process mats have an extremely consistent fiber distribution and density with fine, uniform perforations that are large enough to provide adequate venting during roof application, but small enough to properly stabilize the built-up roof membrane bitumen.

Glass fiber roofing mats, made by the dry process, have a porous, lace-curtain appearance with many relatively large, irregularly sized openings that may not properly stabilize the built-up roof membrane bitumen. Thus, while glass fiber roofing mats made by a dry laid process may be used in the method of the present invention to form built-up roofing products, roofing mats made by the wet laid process are preferred.

SUMMARY OF THE INVENTION

The present invention is directed to a method of manufacturing built-up roofing products, such as roofing felts, cap sheets and base sheets, from fibrous mats which reduces the amount of bitumen, such as asphalt or coal tar, required to form the built-up roofing products without adversely affecting the performance of the built-up roofing products in any appreciable manner. The method of the present invention for manufacturing the built-up roofing products includes: supplying a fibrous roofing mat (preferably a glass fiber roofing mat) to a manufacturing process; moisturizing the roofing mat during the manufacturing process to increase the water content of the roofing mat and reduce the amount of hot bitumen required to coat the roofing mat; and applying a hot bituminous coating to one or both major surfaces of the roofing mat subsequent to increasing the moisture content of the roofing mat.

Preferably, the moisture content of the roofing mat is increased by a small amount during the manufacturing process by applying steam (water vapor) to one or both major surfaces of the roofing mat. The steam can be applied to the roofing mat in the open or within a humidifying chamber. By increasing the moisture content of the roofing mat through the application of steam to one or both major surfaces of the roofing mat, the amount of hot bitumen (hot asphalt or coal tar) required to coat the roofing mat is reduced. The moisture added to the roofing mat by the moisturizing process of the present invention is driven off when the hot bitumen is applied to the moisturized roofing mat and the built-up roofing products made by the method of the present invention are typically only about 0.2% water by weight which is a moisture content well below the 1.0% water by weight permitted by ASTM 2178.

It is also contemplated that the moisture content of the roofing mat could be increased by applying a water mist or spray to one or both major surfaces of the roofing mat. However, only a small increase in the moisture content of the roofing mat is required by the method of the present invention to reduce the amount of hot bitumen coating required to coat the mat and that moisture must be capable of being driven off when the hot bitumen is applied to the roofing mat. It is believed that the application of a water mist or spray to the roofing mat would probably over saturate the roofing mat with relatively large drops of water that could not easily be driven off by the application of the hot bitumen thereby leaving residual water in the finished built-up roofing product. Thus, the use of liquid water, in the form of a mist or spray, to increase the moisture content of the roofing mat could cause problems: a) due to the formation of voids in the bituminous coating subsequently applied to the roofing mat from water drops in or on the roofing mat; and/or b) due to the retention of water in the finished built-up roofing product (e.g. a roofing felt) which could result in blisters in a finished roof made with the built-up roofing product. Accordingly, although possible, moisturizing the roofing mat by the application of a water mist or spray is not recommended in the method of the present invention.

In addition to reducing the amount of bitumen required to form the roofing felts, a cost reduction, the method of the present invention enables a reduction in the coater roll and scraper tension used in the manufacturing process thereby reducing the number of mat breakages during the manufacturing process. The method has also resulted in less bitumen build-up on the process equipment, resulting in fewer process shutdowns for roll cleanup.

The formation of lighter roofing felts, cap sheets, base sheets and similar built-up roofing products having less asphalt or coal tar, by the process of the present invention enables the bitumen coated roofing mats in the process of the present invention to cool faster, at the same line speed, than heavier bitumen coated roofing mats that are coated with greater amounts of bitumen. Thus, less release agent is needed to keep the bitumen coated roofing mat of the present invention from adhering to the process equipment and to prevent adjacent convolutions of the built-up roofing product made by the method of the present invention from adhering to each other in the roll of finished product.

DESCRIPTION OF THE PREFERRED EMBODIMENTS

Figure 1:
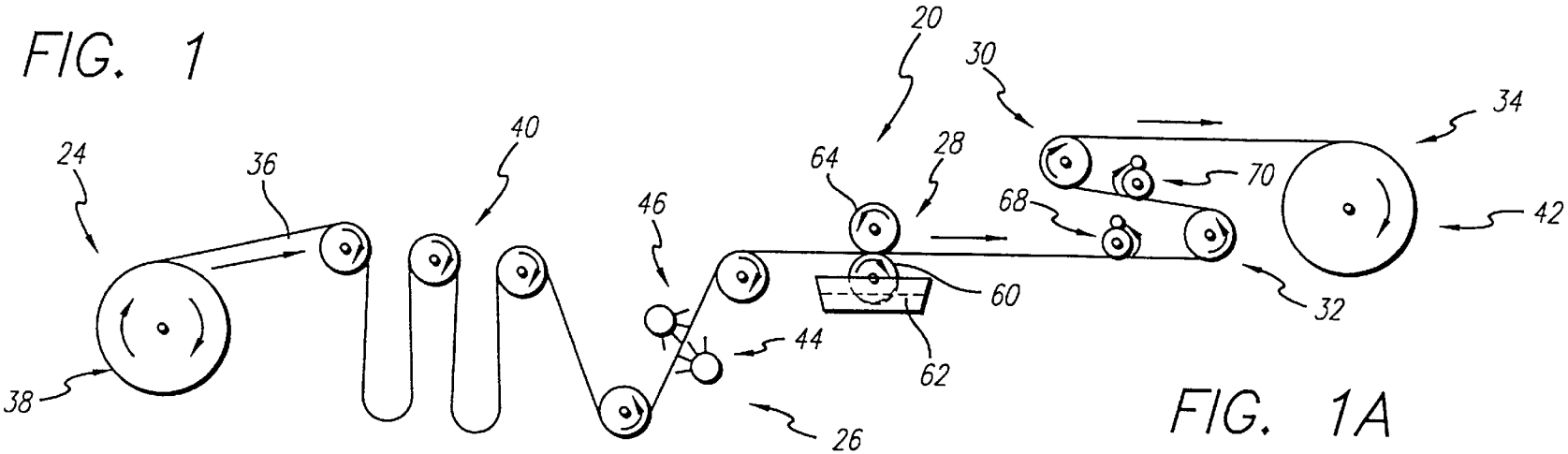
FIG. 1 is a schematic of a portion of a production line utilizing the method of the present invention to manufacture built-up roofing products from moisture conditioned fibrous mats.

As schematically shown in FIG. 1, a production line 20 for manufacturing roofing felts, cap sheets, base sheets and similar built-up roofing products 22 according to the method of the present invention typically includes: a roofing mat supply station 24, a moisturizing station 26, a hot bitumen coating station 28, a release or parting agent application station 30, a cooling station 32, and a windup station 34. Preferably, the process for manufacturing the built-up roofing products 22 is a continuous, on line process.

As schematically shown, a fibrous roofing mat 36 is withdrawn from a supply roll 38 and normally passed through a dry looper 40 which provides a reserve of roofing mat 36 in the production line 20 to permit the production line, of this preferably continuous manufacturing process, to continue running during a supply roll changeover without interruption. The fibrous roofing mat 36 passes from the dry looper 40 to the moisturizing station 26 where moisture, e.g. steam (water vapor), is applied to one or both sides of the roofing mat 36 to increase the moisture content of the roofing mat and thereby reduce the amount of bitumen (e.g. asphalt or coal tar) applied to the roofing mat in the hot bitumen coating station 28. After the fibrous roofing mat 36 has been moisturized in the moisturizing station 26, the roofing mat is passed through the hot bitumen coating station 28 where hot bitumen is applied to the roofing mat to saturate or impregnate the roofing mat 36 with bitumen and drive off the moisture in the roofing mat including the moisture added in the moisturizing station (the finished built-up roofing products made by the process can easily meet ASTM standard 2178 by having less than 1.0% water by weight and typically less than 0.2% water by weight). Normally, the bitumen coated roofing mat 36 is then passed through the release agent application station 30 where a release agent, e.g. a liquid release agent or a sand surfacing agent, is applied to one or both major surfaces of the bitumen coated roofing mat to keep the bitumen coated roofing mat from adhering to the process equipment or to other convolutions of the bitumen coated roofing mat when the finished product (the roofing felt, the cap sheet, the base sheet or a similar built-up roofing product 22) is wound up into a roll 42 in the windup station 34 for storage and shipment. Typically, the bitumen coated roofing mat 36 is also passed through the cooling station 32 to cool the bitumen in the roofing mat prior to winding the cooled bitumen coated roofing mat (the built-up roofing product 22) into the built-up roofing product roll 42 in the windup station 34. The release agent application station 30 is normally located at the upstream end of the cooling station 32.

The roofing mat 36 may be a dry laid or wet laid fiber mat made from glass fibers and/or other fibers having the performance characteristics and physical properties required to provide a roofing mat with the required physical properties and performance characteristics, such as but not limited to, resistance to the elements (weather conditions), reinforcing strength, fire resistance, porosity, moisture resistance and the ability to accept hot bitumen such as asphalt or coal tar. However, preferably, the roofing mat 36, used in the method of the present invention, is a wet laid glass fiber roofing mat, such as but not limited to, DURA-GLASS IV and DURA-GLASS VI roofing mat, sold by Johns Manville International, Inc.

Figure 2:
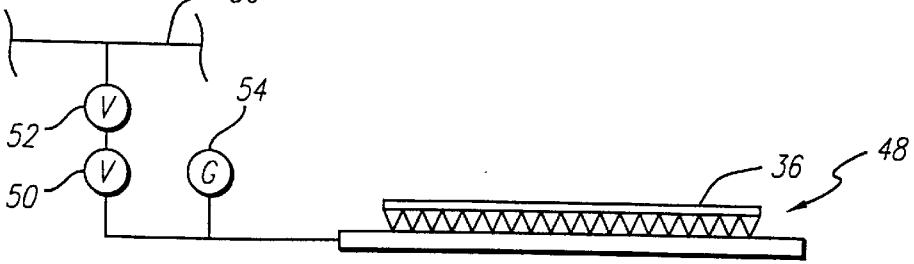
FIG. 2 is a schematic of one embodiment of the steam (water vapor) or mist (liquid water) application equipment that can be used in the moisturizing station of a production line utilizing the method of the present invention.

Preferably, the moisturizing station 26 has steam (water vapor) application equipment 44 that applies steam to at least one major surface of the roofing mat 36 and may have steam (water vapor) application equipment 46 for applying steam to the second major surface of the roofing mat 36. While not shown, the steam application equipment 44 and/or 46 may be enclosed to form a humidifying chamber through which the roofing mat 36 passes on its path to the hot bitumen coating station 28. As best shown in FIG. 2, the steam equipment 44 and/or 46, preferably includes: a steam emitting tube 48 that extends transversely across the entire width of the roofing mat 36 to apply steam to the entire width of the roofing mat; a conventional regulator valve 50 for regulating the pressure of the steam supplied to the steam emitting tube 48; a conventional on/off valve 52 for turning the steam supply to the steam application equipment 44 and/or 46 on and off; a pressure gauge 54 for measuring and displaying the pressure of the steam supplied to the steam emitting tube 48; and a supply of steam, e.g. plant steam at about 250° F., from a steam header supply line 56.

When the roofing mat 36 is moisturized with steam (water vapor), the steam emitting tube 48 is preferably about one half inch pipe with a series of 0.125 inch diameter holes (spaced about one inch apart and extending for the entire width of the roofing felt 36) for distributing the steam on and into the roofing mat 36 to raise the moisture content of the roofing mat 36. The pressure of the steam applied to the major surface(s) of the roofing mat 36 is varied to regulate the increase in the moisture content of the roofing mat and achieve a selected or desired moisture content that reduces the amount of hot bitumen (e.g. asphalt or coal tar) accepted by the roofing mat 36 in the hot bitumen application station 28 by the desired or selected amount. The pressure of the steam applied to a roofing mat 36 of a given thickness is increased to cause a greater increase in the moisture content of that roofing mat. The pressure of the steam applied to a roofing mat is also increased as the thickness of the roofing mat 36 is increased to achieve the same percent by weight increase in moisture content of the thicker roofing mat as in a thinner roofing mat.

While the pressure of the steam applied to the major surface(s) of the roofing mat 36 can be outside of the following limits, it is preferred to apply the steam to the major surface(s) of the roofing mat 36 at pressures between about 5 psig (pounds per square inch gauge) and about 30 psig. The use of steam pressures that are too low may fail to add sufficient moisture to the roofing mat to properly condition the roofing mat for the application of the hot bituminous coating and the use of steam pressures that are too high may damage the roofing mat or increase the moisture content of the roofing mat beyond that required to properly condition the roofing mat for the application of the hot bituminous coating.

While not recommended, if the roofing mat 36 is moisturized with liquid water in the form of a mist or spray, the mist emitting tube 48 is preferably about a one half inch pipe with a series of spaced apart holes extending for the entire width of the roofing felt 36 for distributing the mist on and into the roofing mat 36 to raise the moisture content of the roofing mat 36. The pressure of the liquid water applied to the major surface(s) of the roofing mat 36 is preferably between about 5 psig and about 30 psig and is varied to regulate the increase in the moisture content of the roofing mat and achieve a selected or desired moisture content that reduces the amount of hot bitumen (e.g. asphalt or coal tar) accepted by the roofing mat 36 in the hot bitumen application station 28 by the desired or selected amount. The pressure of the liquid water applied to a roofing mat 36 of a given thickness is increased to cause a greater increase in the moisture content of that roofing mat. The pressure of the liquid water applied to a roofing mat is also increased as the thickness of the roofing mat 36 is increased to achieve the same percent by weight increase in moisture content of the thicker roofing mat as in a thinner roofing mat.

As discussed above in the Summary of the Invention, the use of liquid water, in the form of a mist or spray, to increase the moisture content of the roofing mat could over saturate the roofing mat 36 with relatively large drops of water that could not easily be driven off by the application of the hot bitumen thereby leaving residual water in the finished built-up roofing product. Thus, the use of liquid water, in the form of a mist or spray, to increase the moisture content of the roofing mat could cause problems: a) due to the formation of voids in the bituminous coating subsequently applied to the roofing mat from water drops in or on the roofing mat; and/or b) due to the retention of water in the finished product (the roofing felt) which could result in blisters in the finished roof made with the roofing felt. Accordingly, although possible, moisturizing the roofing mat by the application of a water mist or spray is not recommended in the method of the present invention.

In the hot bitumen application station 28, hot bitumen, e.g. asphalt at temperatures between about 420° F. and about 450° F., is preferably applied to one or both surfaces of the roofing mat 36 by conventional bitumen application equipment commonly used in built-up roofing product production lines. As schematically shown in FIG. 1, the hot bitumen is being applied to the underside or first major surface of the roofing mat 36 where the hot bitumen is absorbed into the roofing mat. As shown, a heated coating application roll 60 picks up hot bitumen from a bath 62 of hot bitumen and deposits the hot bitumen on the underside of the roofing mat. A backup roll 64 cooperates with the coating application roll 60 to ensure that the roofing mat 36 becomes impregnated with the hot bitumen.

Figure 1A:
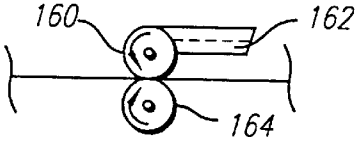
FIG. 1A is a schematic of a portion of a hot bitumen application station that may be used in the method of the present invention.
Figure 3:
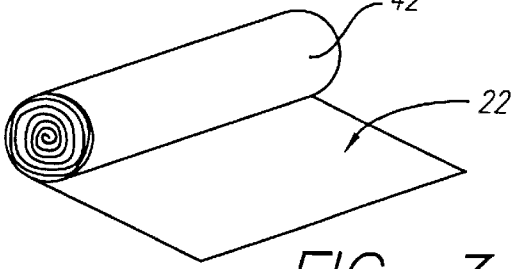
FIG. 3 is a perspective view of a built-up roofing product made by the process of the present invention.

For applications where, due to the thickness of the roofing mat 36 or other reasons, hot bitumen is applied to both major surfaces of the roofing felt, FIG. 1A schematically shows a second set of application rolls 160 and 164 for applying hot bitumen to the upper or second major surface of the roofing mat where the hot bitumen is absorbed into the roofing mat. When used, this second set of application rolls 160 and 164 is located intermediate the first set of application rolls 60 and 64 and the release agent application station 30 of FIG. 1. As shown, the heated coating application roll 160 picks up hot bitumen from one end of a bath 162 of hot bitumen and deposits the hot bitumen on the upper or second major surface of the roofing mat 36. A backup roll 164 cooperates with the coating application roll 160 to ensure that the roofing mat 36 becomes impregnated with the hot bitumen.

With the method of the present invention, the moisture content of the roofing mat 36 is adjusted until the desired or selected amount of hot bitumen is accepted by the roofing mat. While the amount of hot bitumen accepted by the roofing mat 36 is regulated through the moisturizing of the roofing mat 36 to be less than that of the unconditioned roofing mat (the roofing mat before it has been moisture conditioned), the degree of moisture conditioning of the roofing mat (the degree of increase in the moisture content of the roofing mat) can be varied to vary the amount of hot bitumen accepted by the roofing mat. When moisture is applied to only one major surface of the roofing mat 36 in the moisturizing station 26, the hot bitumen is preferably applied to the same major surface in the hot bitumen application station 28.

After the hot bitumen has been applied to the roofing mat 36 in the hot bitumen application station 28, a release agent such as a liquid parting agent, is normally applied to one or both major surfaces of the bitumen coated roofing mat 36. The release agent is applied by conventional means, such as application rolls 68 and 70, which extend transversely across the entire width of the bitumen coated roofing mat to apply the release agent to the entire surface(s) and prevent the bitumen coated roofing mat from sticking to the equipment or to itself. The bitumen coated roofing mat is then cooled in the cooling station 32 prior to winding the finished roofing felt, cap sheet, base sheet or similar built-up roofing product 22 into the roll 42 in the windup station 34 for storage and shipment.

When compared to the weights of roofing felts made with roofing mats that have not been moisturized (unconditioned roofing mats), the average weights of roofing felts 22 made by the method of the present invention, can be reduced in weight by up to about 15% to about 20% (through a reduction in the amount of bitumen used in the roofing felts) without appreciably affecting the physical properties of the roofing felts. Examples of two roofing felts: sold by Johns Manville International, Inc.; made by the method of the present invention; and reduced in average weight between about 15% and 20%; are GlasPly Premier roofing felts which comply with ASTM D 2178 Type VI requirements and GlasPly IV roofing felts which comply with ASTM D 2178 Type IV requirements. Of course the method of the present invention can be used to reduce the weights of roofing felts, when compared to roofing felts made from roofing mats that have not been moisturized, by amounts less than 15%, such as but not limited to amounts of about 5% or 10%, and by amounts that exceed 20%. However, with weight reductions in excess of 20%, the roofing felt may not comply with ASTM D 2178 Type IV or VI requirements.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of manufacturing built-up roofing products, comprising:

supplying a fibrous roofing mat to a manufacturing process;

moisturizing the roofing mat by applying moisture to a first major surface of the roofing mat during the manufacturing process to increase the moisture content of the roofing mat and reduce the amount of hot bitumen accepted by the roofing mat when coated with hot bitumen during the manufacturing process; and applying a hot bituminous coating to a major surface of the roofing mat during the manufacturing process after the moisture content of the roofing mat has been increased by moisturizing.

2. The method of manufacturing built-up roofing products according to claim 1, wherein: the roofing mat is moisturized by applying steam to the first major surface of the roofing mat.

3. The method of manufacturing built-up roofing products according to claim 2, wherein: the steam is applied at a pressure between about 5 psig and about 30 psig.

4. The method of manufacturing built-up roofing products according to claim 3, wherein: the pressure of the steam is adjusted to control the amount of increase in the moisture content.

5. The method of manufacturing built-up roofing products according to claim 1, wherein: the roofing mat is moisturized by applying a liquid mist to the first major surface of the roofing mat.

6. The method of manufacturing built-up roofing products according to claim 5, wherein: the liquid mist is applied at a pressure between about 5 psig and about 30 psig.

7. The method of manufacturing built-up roofing products according to claim 6, wherein: the pressure of the liquid mist is adjusted to control the amount of increase in the moisture content.

8. The method of manufacturing built-up roofing products according to claim 1, 2 or 5, wherein: the moisture content of the roofing mat is increased by the moisturizing of the roofing mat in an amount sufficient to reduce the average weight of the roofing felt produced by at least 5%, when compared to roofing felt made from the roofing mat that has not been moisturized, through a reduction in the amount of bitumen accepted by the roofing mat.

9. The method of manufacturing built-up roofing products according to claim 8, wherein: the average weight reduction is at least 10%.

10. The method of manufacturing built-up roofing products according to claim 8 wherein: the roofing mat is a wet laid mat of randomly oriented glass fibers.

11. The method of manufacturing built-up roofing products according to claim 1, 2 or 5 wherein: the moisture content of the roofing mat is varied during a production run of the manufacturing process to vary the amount of bitumen accepted by the roofing mat.

12. The method of manufacturing built-up roofing products according to claim 1, wherein: the hot bitumen is applied to the first major surface of the roofing mat.

13. The method of manufacturing built-up roofing products according to claim 1, wherein: the moisture is applied to a second major surface of the roofing mat during the manufacturing process to increase the moisture content of the roofing mat and reduce the amount of asphalt accepted by the roofing mat.

14. The method of manufacturing built-up roofing products according to claim 13, wherein: the roofing mat is moisturized by applying steam to the first and second major surfaces of the roofing mat.

15. The method of manufacturing built-up roofing products according to claim 14, wherein: the steam is applied at a pressure between about 5 psig and about 30 psig.

16. The method of manufacturing built-up roofing products according to claim 15, wherein: the pressure of the steam is adjusted to control the amount of increase in the moisture content.

17. The method of manufacturing built-up roofing products according to claim 13, wherein: the roofing mat is moisturized by applying a liquid mist to the first and second major surfaces of the roofing mat.

18. The method of manufacturing built-up roofing products according to claim 17, wherein: the liquid mist is applied at a pressure between about 5 psig and about 30 psig.

19. The method of manufacturing built-up roofing products according to claim 18, wherein: the pressure of the liquid mist is adjusted to control the amount of increase in the moisture content.

20. The method of manufacturing built-up roofing products according to claim 13, 14 or 17, wherein: the moisture content of the roofing mat is increased by the moisturizing of the roofing mat in an amount sufficient to reduce the average weight of the roofing felt produced by at least 5%, when compared to roofing felt made from the roofing mat that has not been moisturized, through a reduction in the amount of bitumen accepted by the roofing mat.

21. The method of manufacturing built-up roofing products according to claim 20, wherein: the average weight reduction is at least 10%.

22. The method of manufacturing built-up roofing products according to claim 20 wherein: the roofing mat is a wet laid mat of randomly oriented glass fibers.

23. The method of manufacturing built-up roofing products according to claim 13, 14 or 17 wherein: the moisture content of the roofing mat is varied during a production run of the manufacturing process to vary the amount of bitumen accepted by the roofing mat.

24. The method of manufacturing built-up roofing products according to claim 1, 2 or 5 wherein: the application of the hot bituminous coating drives off moisture from the roofing mat and the built-up roofing product contains less than 1.0% water by weight.

* * * * *